US006354102B1

(12) United States Patent
Hozumi et al.

(10) Patent No.: US 6,354,102 B1
(45) Date of Patent: Mar. 12, 2002

(54) FREEZING DEVICE FOR SUPERCOOLED WATER

(75) Inventors: Tsutomu Hozumi, Machida; Akio Saito; Seiji Okawa, both of Yokohama; Hiroyuki Kumano, Meguro-Ku, all of (JP)

(73) Assignee: Tokyo Institute of Technology, Tokyo (JP)

( * ) Notice: Subject to any disclaimer, the term of this patent is extended or adjusted under 35 U.S.C. 154(b) by 0 days.

(21) Appl. No.: 09/626,144

(22) Filed: Jul. 26, 2000

(30) Foreign Application Priority Data

Dec. 28, 1999 (JP) ..... 11-374375

(51) Int. Cl.[7] ..... F25C 1/00
(52) U.S. Cl. ..... 62/340
(58) Field of Search ..... 62/66, 340, 356

(56) References Cited

U.S. PATENT DOCUMENTS 4,059,970 A * 11/1977 Loeb ..... 62/66
4,062,201 A * 12/1977 Schumacher et al. ..... 62/66
4,261,182 A * 4/1981 Elliott ..... 62/66
5,533,344 A * 7/1996 Duh ..... 62/340
5,588,304 A * 12/1996 Koiso et al. ..... 62/340

* cited by examiner

*Primary Examiner*—William E. Tapolocai
(74) *Attorney, Agent, or Firm*—Oliff & Berridge, PLC

(57) ABSTRACT

The object of this invention is to provide a comparatively small freezing device capable of freezing supercooled water instantly at any desired time and place even though the water is at a poorly supercooled state which is resistive to freezing, by actively resolving the supercooled state. The object is achieved by providing a freezing device comprising a cylinder 1 to receive supercooled water, at least one piston 2, 3 to fit liquid-tight to the cylinder to move therein, which, by moving through the cylinder, introduces supercooled water into the cylinder, gives a mechanical impact to the supercooled water enclosed in the cylinder, and expels water in which the supercooled state has been resolved in the presence of impact, out of the cylinder, and a water inlet 1*a* and outlet 1*b* to be connected to at least one of the cylinder and piston in such a way as to allow their opening and closing.

4 Claims, 7 Drawing Sheets

FREEZING DEVICE FOR SUPERCOOLED WATER

BACKGROUND OF THE INVENTION

1. Field of the Invention

The present invention relates to a freezing device for supercooled water to be incorporated into an ice-based heat accumulating unit of a freezer for resolving the supercooled state of liquid water by freezing it, particularly to a freezing device whereby it is possible to actively freeze supercooled water of low supercool level at any desired time and at any desired place.

2. Prior Art

A known prior technique for resolving (freezing) the supercooled state of liquid water consists of allowing a flow of supercooled water to freely fall onto a plate to make the water freeze there.

However, with this technique, supercooled water will require a sufficiently long distance to fall through for its secure freezing, which will lead to enlargement of the necessary unit. Moreover, with this technique, it is impossible to actively interfere with the supercooled state of water to make the water freeze at a desired time and place, nor to freeze the supercooled water if its supercooled state is at a low level.

To meet such flaws inherent to the prior art, the present invention aims at providing a freezing device being small in size, and capable of so actively interfering with the supercooled state of liquid water as to freeze it rapidly at any desired time and place, even if the supercooled state is at such a low level as to be resistive to freezing.

SUMMARY OF THE INVENTION

The freezing device for supercooled water provided by this invention to serve as an effective solution of above problems comprises a cylinder to receive supercooled water; at least one piston to fit liquid-tight to the cylinder to move therein, which, by moving through the cylinder, introduces supercooled water into the cylinder, gives a mechanical impact to the supercooled water, thereby resolving the supercooled state of the water, and expels water in which the supercooled state has been resolved from the cylinder; and a water inlet and outlet to be provided on at least one of the cylinder and piston in such a way as to allow their opening and closure at a desired timing. The water inlet and outlet may be substituted for a passage which serves both as an inlet and outlet.

The freezing device operates as follows: the cylinder is immersed in supercooled water; the water inlet is opened and the piston is moved in a predetermined direction, to introduce supercooled water into the cylinder until the water fills the latter; after the water inlet has been closed, the piston is instantly moved towards the supercooled water, to give an impact against the latter; and the supercooled state of water is interfered therewith, and part of water is solidified to form nuclei for freezing. Later, the water outlet is opened; the piston is moved in a direction opposite to the above predetermined direction; and water whose supercooled state has been resolved is expelled into bulk supercooled water outside the cylinder to freeze the bulk supercooled water in a successive manner.

Accordingly, the freezing device of this invention, even though it may be reduced in size as compared to a previous similar device, can interfere so actively with the supercooled state of liquid water which is considerably resistive to freezing, that it freezes the latter instantly at any desired time. Because of its comparatively small size, it is possible to prepare many of the devices to arrange them in supercooled water, or to move the device from one place to another, and thus to freeze supercooled water at any desired place.

Thus, if the freezing device of this invention is incorporated in an ice-based heat accumulating system to serve as a supercooled state resolving device, it will be possible to greatly reduce the freezing load of the freezer, which will in turn contribute to saving of energy, effective use of a freezer or air-conditioner, and protection of the environment.

With the freezing device of this invention, the cylinder may have a water inlet and outlet formed thereon, and include two pistons, of which one opens/closes the water inlet and outlet, while the other introduces supercooled water into the cylinder, gives an impact against the water filling the cylinder, and expels the water whose supercooled state has been resolved outside the cylinder.

The above freezing device has two pistons, one for opening/closing the water inlet and outlet and the other for introducing supercooled water into the cylinder and giving an impact against the water; after supercooled water has been introduced into the cylinder, one piston closes the water inlet and outlet to seal the cylinder, and the other piston is pulled apart from the supercooled water in the cylinder; air in the supercooled water within the cylinder is subjected to expansion under reduced pressure to form an accumulation of air having a negative pressure in the cylinder; the piston continues to retreat in the face of an elastic counter pull caused by the negative pressure of air; at this state the pull to the piston is released momentarily; the piston is moved forcibly at a high speed by the counter pull towards the supercooled water (to compress the air); and the piston bumps against the surface of supercooled water to give an impact to the latter.

Hence, it is possible for the above device to give a hard impact against supercooled water in the cylinder through the piston, although it is simple in structure.

The freezing device of this invention may have a heater around the cylinder. Such a freezer device can heat the cylinder with the heater while water whose supercooled state has been resolved in the presence of an impact from the piston is being discharged from the cylinder. This prevents adhesion of ice-crystal nuclei to the inner wall of the cylinder without overheating of supercooled water adjacent to the cylinder, and thus ensures continuous operation of the freezer device in question.

DESCRIPTION OF THE PREFERRED EMBODIMENTS

Figure 1A:
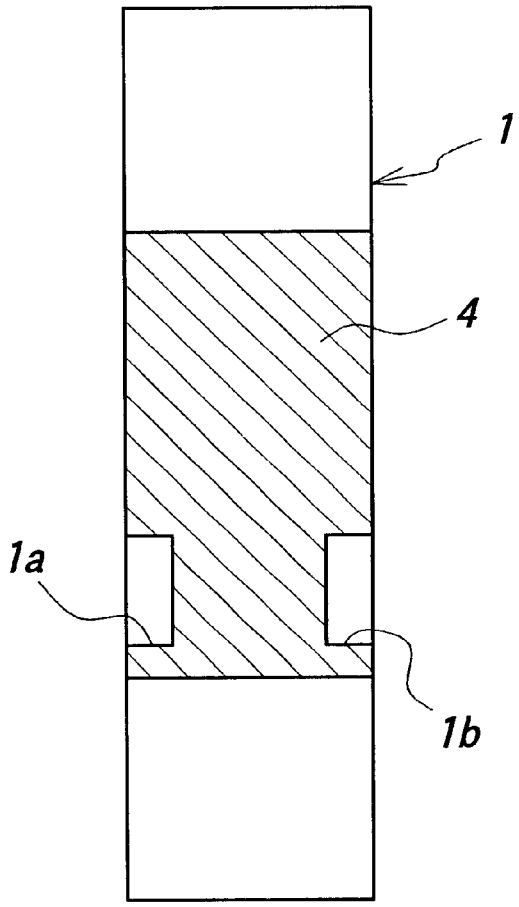
FIG. 1*a* gives the lateral view of an example of the freezing device for supercooled water of the present invention, while FIG. 1*b* the sectional view of the same example to show its internal structure.
Figure 1B:
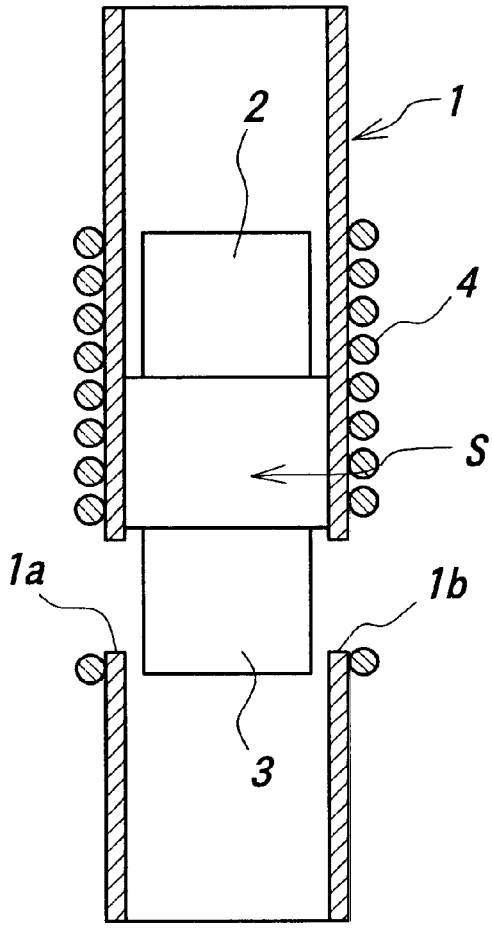

The preferred embodiments of this invention will be detailed below by means of examples with reference to attached figures. FIG. 1*a* gives the lateral view of an example of the freezing device for supercooled water of this invention, while FIG. 1*b* the sectional view of the same example to show its inner structure. In those figures, 1 represents a cylinder; 2 and 3 pistons; and 4 an electric coiled heater.

The device of this example has a cylinder 1 which contains an inner space whose cross-section (a surface normal to the page surface and extending in left and right directions) is uniform in its shape and area (the shape not being limited to a straight or cylindrical tube); two pistons 2 and 3 which fit slidably and liquid tight via an appropriate sealing material (not illustrated here) to the cylinder and form a supercooled water receiving space S between them; and piston driving means (not illustrated here) each consisting, for example, of an electromagnetic solenoid or the like which are placed at the ends of the cylinder to drive and retreat the two pistons 2 and 3 independently.

The cylinder 1 has a water inlet 1*i a* and outlet 1*b* formed thereon; and piston 3 not only opens/closes the water inlet and outlet 1*a* and 1*b*, but also carries upward supercooled water close to the water inlet and outlet 1*a* and 1*b*. The cylinder also has an electric coiled heater 4 wound around it.

The operation of the device of this example will be described below with reference to FIGS. 2 to 5. In those figures, W represents supercooled water, and D the flow direction of supercooled water outside the cylinder. The following description mainly concerns with how to freeze a flow of supercooled water which is comparatively resistive to freezing, but, needless to say, the device of the present invention does not require supercooled water to flow, and may be applied for freezing of static supercooled water.

Figure 2B:
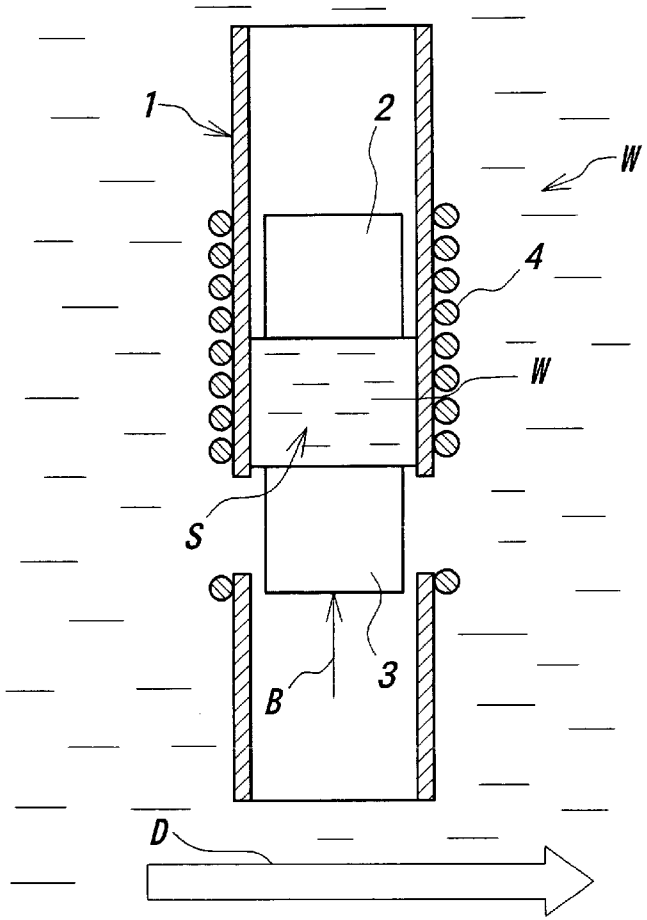
FIGS. 2*a* and 2*b* show the initial steps of a procedure taken by the device of the example for freezing supercooled water.
Figure 2A:
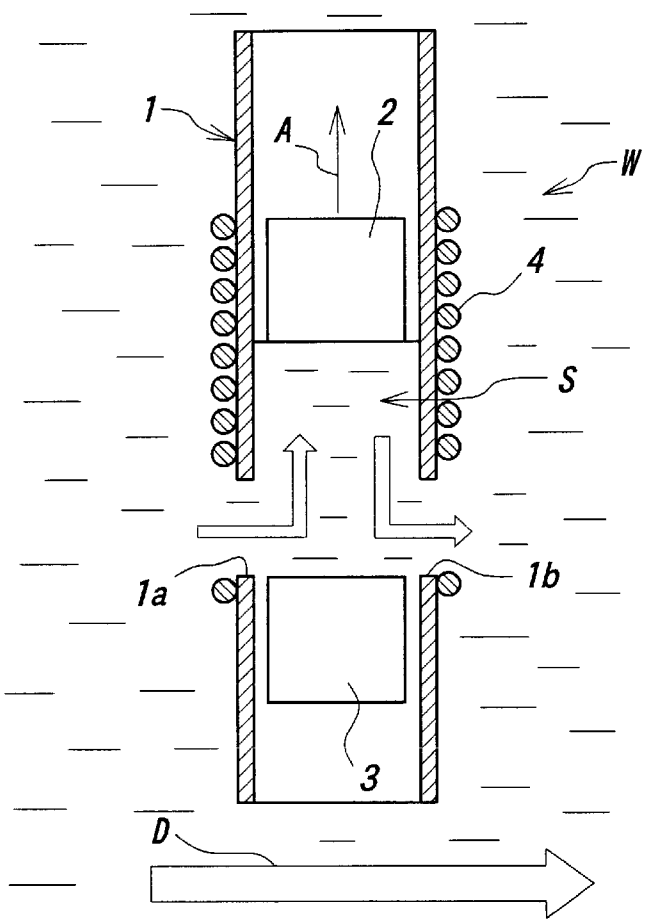

Let's assume for illustration a case where the device of this example is applied to supercooled water flowing in a certain direction. Firstly, as shown in FIG. 2*a*, the piston driving means for piston 3 is activated to drive piston 3 below the water inlet 1*a* and outlet 1*b* of cylinder 1; and the water inlet 1*a* and outlet 1*b* being kept open are directed the former towards upstream and the 1*a* latter towards downstream of the flow of supercooled water whose direction is indicated by symbol D; the device is immersed in supercooled water; and the piston driving means for piston 2 is then activated to retreat piston 2 upward as indicated by arrow A of the figure, to allow supercooled water on the upstream side to enter into cylinder 1. After entry of supercooled water into cylinder 1, as shown in FIG. 2*b*, the piston driving means for piston 3 is activated to drive piston 3 upward as indicated by arrow B in the figure, until the piston closes the water inlet 1*a* and outlet 1*b*; the supercooled water receiving space S formed between the two pistons is filled with supercooled water; and the opposite surfaces of pistons 2 and 3 contact with the respective surfaces of supercooled water enclosed within space S. During this operation, the electric coiled heater is kept switched off.

Figure 3:
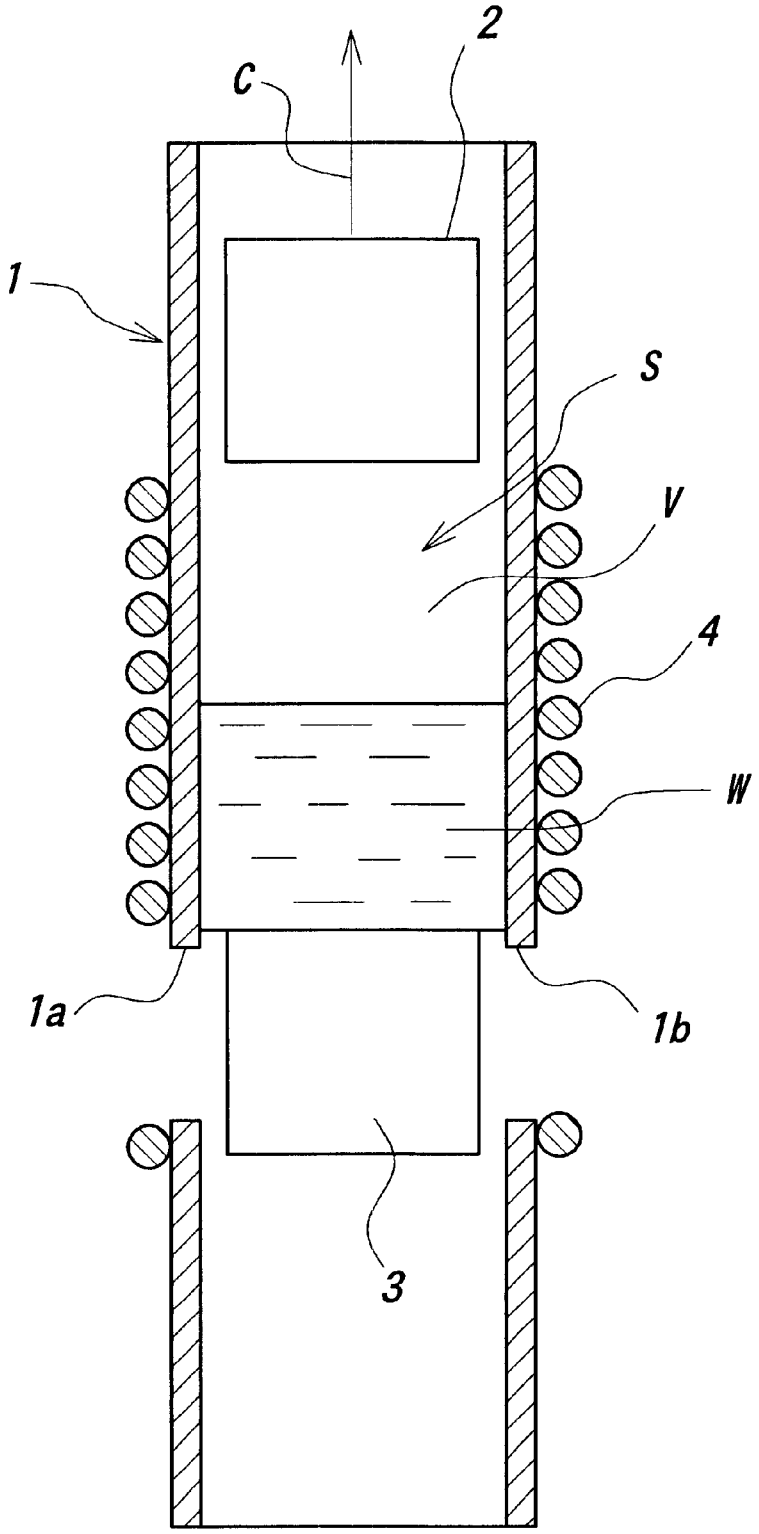
FIG. 3 illustrates the next step of the procedure.
Figure 4A:
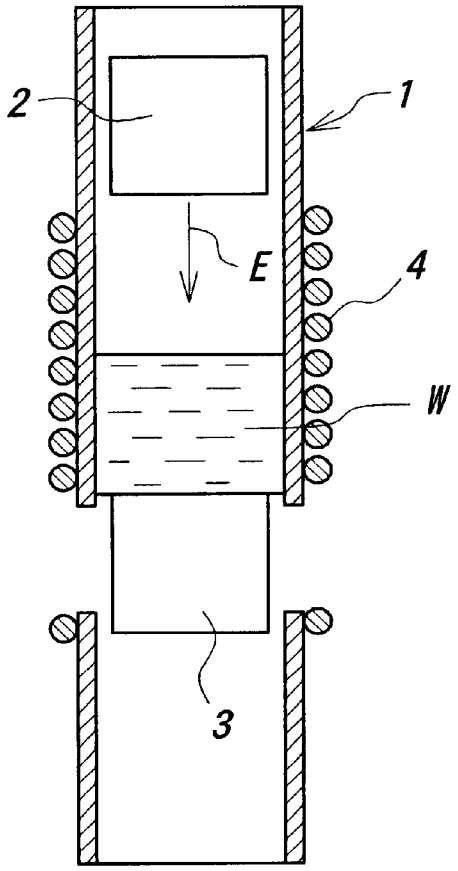
FIGS. 4*a* and 4*b* illustrate the further steps of the procedure.
Figure 4B:
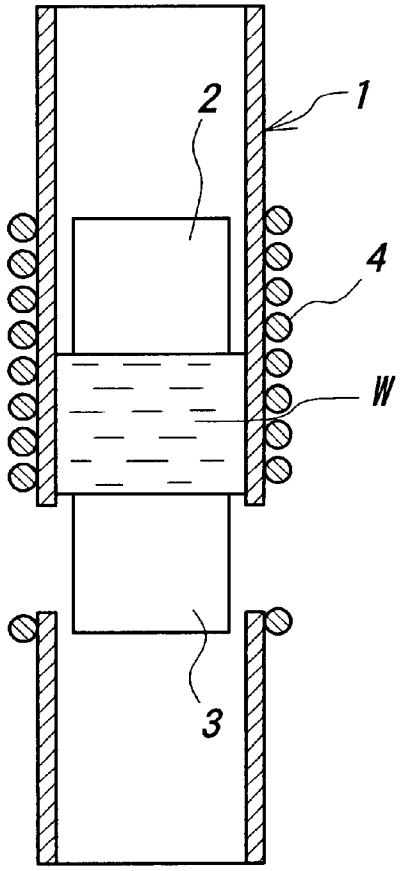

Then, a pull (pulling force) is applied to piston 2 by the piston driving means for piston 2 as shown in FIG. 3; and piston 2 is further retreated upward by the pull as shown by arrow C in the figure. At this moment, the supercooled water receiving space S of the cylinder is expanded; the retreating piston 2 brings air (bubbles) contained in the supercooled water W enclosed in the supercooled water receiving space S to the surface of the water; or the retreating piston 2 allows the supercooled water W enclosed in the supercooled water receiving space S to evaporate under a reduced pressure to evolve water vapor from the surface which then forms an accumulation of gas V having a negative pressure upwards the supercooled water W; and piston 2 continues to retreat in the face of elastic counter pull caused by the negative pressure of gas. During this operation, the electric coiled heater is still kept switched off.

At the next step, the operation of the piston driving means for piston 2 is abruptly discontinued, thereby momentarily releasing the pull to piston 2. Or, at this moment, the piston driving means may be activated so as to give a push (pushing force) to piston 2. Then, piston 2 is forcibly moved downward as shown by arrow E in FIG. 4*a* as a result of counter pull which may be reinforced by the push as described above, towards the supercooled water W enclosed in the supercooled water receiving space S (to compress the water); thus piston 2 heavily bumps against the surface of supercooled water W enclosed in the supercooled water receiving space S; the impact is throughout the water; the supercooled state of the water is resolved under the influence of the impact; and ice-crystal nuclei are formed in the water enclosed in the supercooled water receiving space S. During this operation, the electric coiled heater 4 is still kept switched off.

Figure 5B:
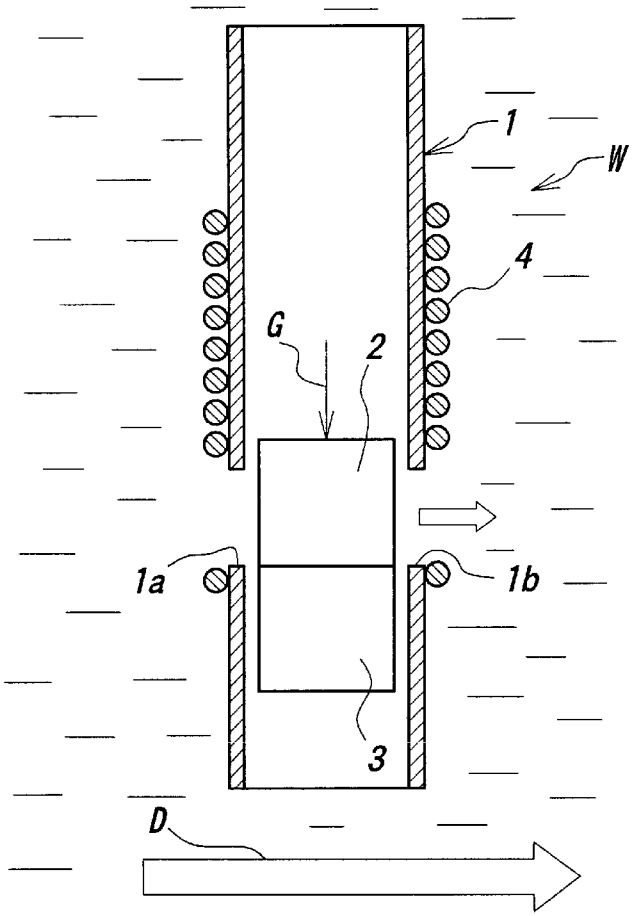
FIGS. 5*a* and 5*b* illustrate the final steps of the procedure.
Figure 5A:
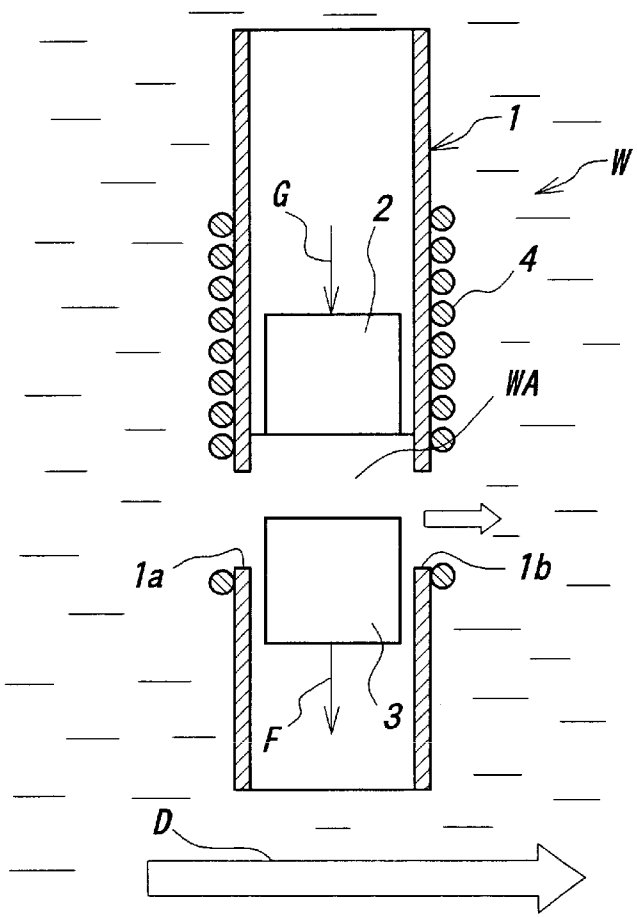

At the next step, the electric coiled heater 4 is switched on to heat cylinder 1; the piston driving means for piston 3 is activated so as to retreat piston 3 downward as shown by arrow F of FIG. 5*a*, thereby opening water inlet 1*a* and outlet 1*b* formed on cylinder 1; supercooled water upstream of cylinder 1 enters into cylinder 1 through water inlet 1*a*, which expels water WA whose supercooled state has been resolved in the presence of the impact, out of cylinder 1 through water outlet 1*b* , to allow the water to flow downstream of cylinder 1.

Piston 3 is further retreated until it is below water inlet 1*a* and outlet 1*b*, and remains there. Then, the piston driving means for piston 2 is activated so as to move piston 2 downward until piston 2 comes into contact with piston 3 as shown by arrow G of FIG. 5*b*, thereby expelling all the water WA containing ice-crystal nuclei within and enclosed in the space S out of cylinder 1. The water WA containing ice-crystal nuclei within thus expelled out of cylinder 1 freezes bulk supercooled water downstream of cylinder 1 in a sequential manner, thereby resolving the supercooled state of adjacent bulk water. While the water WA containing ice-crystal nuclei within is being expelled out of cylinder 1, the electric coiled heater 4 is activated to heat cylinder 1, thereby preventing the adherence of nuclei contained in the water WA enclosed in the supercooled water receiving space S to the inner wall of cylinder 1 which otherwise might occur to interfere with continuous operation of the device in question.

It is possible with the device represented by this example to freeze a flow of supercooled water which is comparatively resistive to freezing, or supercooled water whose supercooled state is at a comparatively low level, by making the above procedure as one cycle, and repeating the cycles thereby continuously developing ice-crystal nuclei in supercooled water for freezing. During the above operation, if supercooled water W enclosed in cylinder 1 contains a sufficient amount of air to develop an adequate volume V of gas having a negative pressure, the impact will be emphasized and thus it will be possible to freeze even supercooled water W whose supercooled state is kept at a low level (whose temperature is not far apart from 0° C.).

Accordingly, the freezing device represented by this example, even though it may be reduced in size as compared to a previous similar device, can interfere so actively with the supercooled state of liquid water which is considerably resistive to freezing, that it freezes the latter at any desired time. Because of its comparatively small size, it is possible to prepare many of the devices to arrange them in supercooled water, or to move the device from one place to another, and thus to freeze supercooled water at any desired place. Thus, if the freezing device of this example is incorporated in an ice-based heat accumulating system to serve as a supercooled state resolving device, it will be possible to greatly reduce the freezing load of the freezer, which will in turn contribute to saving of energy, effective use of a freezer or air-conditioner, and protection of the environment.

The freezing device of this example has two pistons: piston 2 for feeding/discharging of supercooled water and for giving an impact against the water, and piston 3 for opening/closing water inlet 1*a* and outlet 1*b*. Thus, it is possible with this device to give a hard impact against supercooled water enclosed in cylinder 1, although the impact depends on a simple structure consisting only of piston 2.

Moreover, since the freezing device of this example has heater 4 around cylinder 1, it can heat cylinder 1 with heater 4 while water whose supercooled state has been resolved in the presence of an impact is being discharged from cylinder 1. This prevents adhesion of ice-crystal nuclei to the inner wall of cylinder 1 without overheating of supercooled water adjacent to cylinder 1, and thus ensures continuous operation of the freezing device in question.

Figure 6:
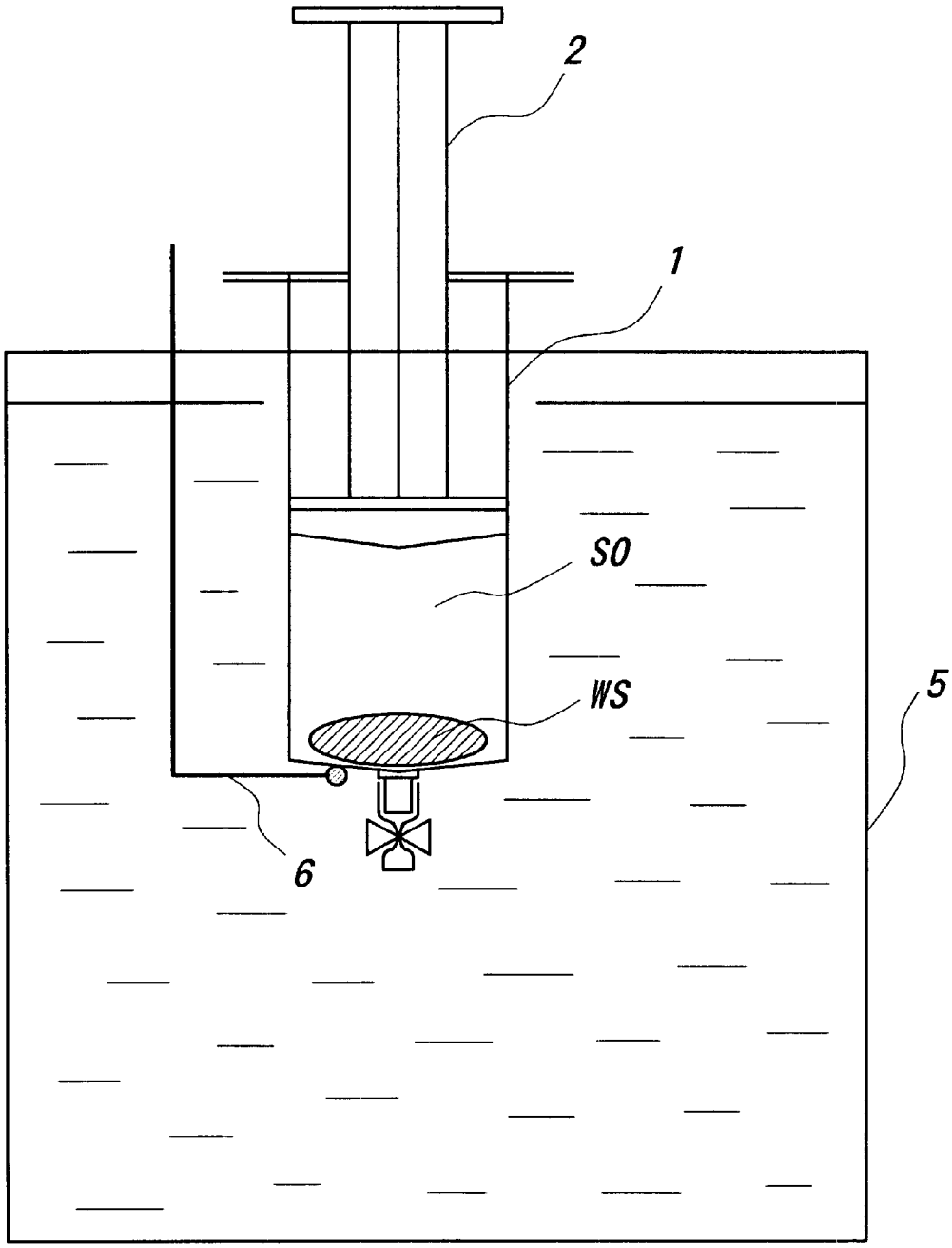
FIG. 6 illustrates an apparatus introduced to serve as a substitute for the freezing device for supercooled water of this invention which has been used in a preparatory experiment.

FIG. 6 illustrates an apparatus introduced to serve as a substitute for the freezing device for supercooled water of this invention that has been used in a preparatory experiment to corroborate the action of the device of this invention. The present inventors made, using this apparatus, a preparatory experiment to demonstrate whether such an impact as described above could cause supercooled water to freeze, and obtained positive results.

The apparatus shown in FIG. 6 was made of a polypropylene syringe having a volume of 25 $cm^3$. In the preparatory experiment, a drop of ultra-pure water WS having a volume of 1 $cm^3$ and removed of visible air bubbles having a diameter of 100 $\mu$m or more was placed in the syringe. The upper portion of the syringe barrel was filled with silicone oil SO, and the bottom of ultra-pure water drop WS was allowed to contact with the tip of syringe (the bottom of the syringe in the figure). Thus, silicone oil SO was inserted between the piston 2 of syringe and the ultra-pure water WS to prevent piston 2 from directly contacting with the water WS. This is for transmitting only an impact from piston 2 to the ultra-pure water WS. The tip of syringe (the lowest end of the syringe in the figure) was closed and thus the interior of syringe formed a closed space.

The syringe prepared as above to serve as an apparatus for the preparatory experiment was cooled in a cooling tank 5 as shown in FIG. 6, and the ultra-pure water WS contained in the syringe was maintained at a supercooled state below 0° C. At this stage, the piston was manually raised until a pulling force developed having an arbitrarily chosen intensity, and then releasing the pull was achieved by taking the hand off the syringe. Then, piston 2 fell in the presence of a negative pressure developed in the internal space of syringe, and an impact developed during this process was transmitted through silicone oil SO to the ultra-pure water WS. In the figure, 6 represents a thermocouple for measuring the temperature of the tip of syringe 1.

Figure 7A:
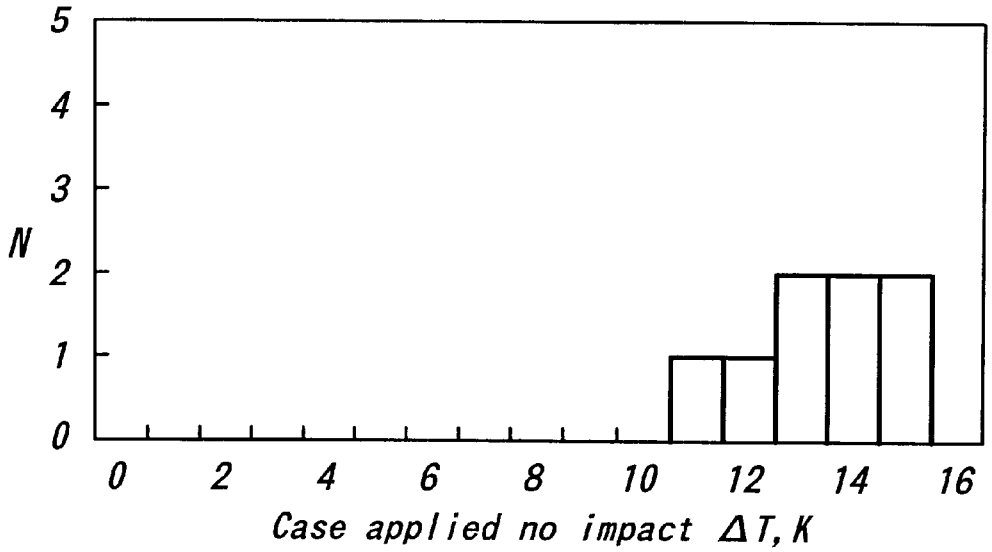
FIGS. 7*a* and 7*b* show the results of the preparatory experiment in which the above apparatus was used.
Figure 7B:
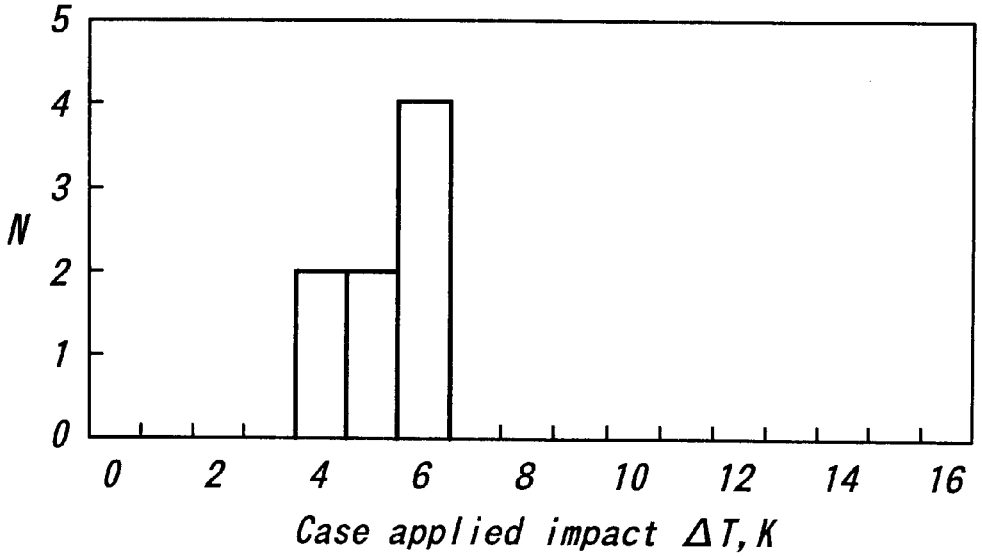

FIG. 7 shows the results of the preparatory experiment where the differences $\Delta T$ of freezing temperatures from 0° C. expressed in absolute values were plotted as a function of observed numbers N. FIG. 7*a* shows the data of a comparative experiment where no impact was applied, while FIG. 7*b* the data of the experiment where piston 2 was allowed to fall to give an impact as stated above.

The results of the preparatory experiment showed that the average of $\Delta T$ or $\Delta T_{ave}$ was 5.8 K when piston 2 was allowed to fall, while the corresponding $\Delta T_{ave}$ was 13.9 K when no impact was applied. Freezing occurred immediately after application of the impact. The present inventors used supercooled water having a comparatively high supercool level in this experiment, to take clear photos of the moment at which freezing occurred, and found that supercooled water having a temperature as high as −3° C. can freeze in the presence of an impact, and that supercooled water even at −1° C. can freeze provided that there are ample air bubbles in that water. From above it was demonstrated that supercooled water even at a poorly supercooled state can freeze in the presence of an impact given by this apparatus.

This invention has been described above by means of examples, but the invention is not limited to the above examples. For example, even though the above examples incorporate two pistons, two pistons may be substituted for one piston; the water inlet and outlet attached to the cylinder or piston may be made at least one with a valve to open and close it; the two pistons may be arranged such that one is for opening/closing the water inlet and outlet, introducing supercooled water into the cylinder, and discharging supercooled water whose supercooled state has been resolved from the cylinder; and the other for applying an impact against supercooled water contained in the cylinder. Although the above examples incorporate an electric coiled heater 4, the heater may be substituted for other types of heater, or use of the heater may be dispensed with.

Furthermore, although the above examples incorporate piston driving means for driving the piston based on an electromagnetic solenoid, the freezing device of this invention can dispense with the use of such a piston driving means, but instead have a member by which the operator can manipulate the piston by band. Or, instead of a water inlet and outlet, an opening may be made on the cylinder or piston, to serve as a water inlet and outlet at the same time.

What is claimed is:

1. A freezing device for supercooled water comprising:

a cylinder to receive supercooled water;

means for supplying super cooled water to the cylinder having; at least one piston to fit liquid-tight to the cylinder to move therein, which, by moving through the cylinder, introduces supercooled water into the cylinder, gives a mechanical impact to the supercooled water enclosed in the cylinder, and expels water in which the supercooled state has been resolved in the presence of impact, out of the cylinder; and a water inlet and outlet to be provided on at least one of the cylinder and piston in such a way as to allow their opening and closing.

2. A freezing device as described in claim 1 wherein:

the cylinder has the water inlet and outlet formed thereupon, and two pistons fitted thereto; and one of the pistons is for opening and closing the water inlet and outlet, and the other for introducing supercooled water into the cylinder, giving an impact to the supercooled water enclosed in the cylinder, and expelling water in which the supercooled state has been resolved in the presence of impact, out of the cylinder.

3. A freezing device as described in claim 1 wherein a heater is placed around the cylinder.

4. A freezing device as described in claim 2 wherein a heater is placed around the cylinder.

* * * * *